United States Patent [19]

Stoehr et al.

[11] Patent Number: 4,553,418

[45] Date of Patent: Nov. 19, 1985

[54] APPARATUS FOR PRODUCING ELONGATED WORKPIECES OF PREDETERMINED TRANSVERSE PROFILE

[75] Inventors: Herbert M. Stoehr, New Berlin; John J. Toben, Milwaukee, both of Wis.

[73] Assignee: Artos Engineering Company, New Berlin, Wis.

[21] Appl. No.: 589,758

[22] Filed: Mar. 15, 1984

[51] Int. Cl.[4] ..... B21D 5/08; B21D 7/06; B21D 43/12; B21B 1/24

[52] U.S. Cl. ..... 72/132; 72/177; 72/181; 72/185; 72/187; 72/418; 72/422

[58] Field of Search ..... 72/130, 132, 177, 338, 72/339, 384, 389, 418, 422, 181, 185, 187; 140/87; 29/160, 163.5 R

[56] References Cited

U.S. PATENT DOCUMENTS

| | | | |
|---|---|---|---|
| 2,220,910 | 11/1940 | Kershaw | 72/177 X |
| 2,262,550 | 11/1941 | Hunter | 72/132 X |
| 2,295,852 | 9/1942 | LeJeune | 72/422 X |
| 2,591,085 | 4/1952 | McCall | 72/422 X |
| 3,393,547 | 7/1968 | Kortan | 72/132 X |
| 4,222,260 | 9/1980 | McDermott | 72/345 X |
| 4,471,641 | 9/1984 | Mitchell | 72/132 |

FOREIGN PATENT DOCUMENTS

| | | | |
|---|---|---|---|
| 241245 | 7/1965 | Austria | 72/418 |
| 2121206 | 11/1971 | Fed. Rep. of Germany | 72/130 |

*Primary Examiner*—E. Michael Combs
*Attorney, Agent, or Firm*—James E. Nilles

[57] ABSTRACT

Flat metal strip of indeterminate length is apertured in a punch press having a flying die set to define a lengthwise succession of identical workpiece blanks connected by strap-like portions of the strip adjacent to its longitudinal edges. That press, each time it operates, makes two apertures that define respective end edges of a blank. The strip is pulled lengthwise through that press by roller forming apparatus which imparts a predetermined transverse profile to it and propels it through a flying shear press whereby each blank is severed from the rest of the strip. On a conveyor having two stretches bridged by the severed blank and moving faster than the strip the severed blank is carried to a folding press. There a ram rises from between the conveyor stretches, lifting the blank off of the conveyor and clamping it against a folding die. The ram raises the blank and the die until the die is stopped, whereupon the ram rises somewhat more to fold the blank, then descends to bring the workpiece down onto other conveyor stretches that carry it away.

14 Claims, 22 Drawing Figures

APPARATUS FOR PRODUCING ELONGATED WORKPIECES OF PREDETERMINED TRANSVERSE PROFILE

FIELD OF THE INVENTION

This invention relates to apparatus for the production of numerous identical workpieces from indefinitely long flat metal strip, each workpiece having a predetermined length between opposite end edges of predetermined shapes and being curved out of flatness across its width to have a predetermined profile which is uniform along its length and which includes a small radius fold paralleling its longitudinal edges; and the invention is more particularly concerned with apparatus for producing such workpieces in a fast, uninterrupted sequence of operations.

BACKGROUND OF THE PRIOR ART

It is well known that flat metal strip can be formed to a predetermined profile across its width that is uniform along its length by passing it lengthwise through a succession of forming roller pairs by which it is progressively worked to the desired transverse profile.

The advantages of roller forming are also well known. A high rate of production is obtained because the metal moves continuously and at relatively high speed as it is converted from flat strip to finished workpieces. Since the process is essentially continuous and automatic, labor costs are minimal; and the equipment needed for roller forming is relatively inexpensive in relation to the high rate of production that it can achieve.

The limitations upon roller forming are also well known. One of these is that only a limited depth of transverse bend or curvature can be imparted to a workpiece by roller forming. For example, an attempt to bring a workpiece to a substantially deep V-shaped or U-shaped transverse profile by roller forming would result in unacceptable scuffing of the workpiece because the radially outer portions of the final-stage forming rollers would have surface speeds much higher than their radially inner portions.

Roller forming can also present problems with respect to cutoff of individual finished workpieces from a roller formed strip. For some operations in which lengthwise moving strip is cut into workpieces it is possible to use a press having a so-called flying die set, that is, a die set which is propelled for motion with the advancing strip while shearing through it and which is thereafter moved oppositely to the direction of strip motion, back to a home position. With such a press there is no need to stop forward motion of the strip each time a cutoff operation is performed, and therefore the strip can maintain the steady, continuous forward movement that is imparted to it in the roller forming process. However, where a flying die set must cut through strip that has been roller formed, the cooperating shearing dies must be curved to match the transverse profile imparted to the strip by the forming rollers, so that the dies will not deform the end portions of each workpiece out of that profile. Substantial costs are involved in grinding such profiled shearing dies and regrinding them when they need sharpening, and therefore it has heretofore been considered feasible only to shear through roller formed strip with dies that produce straight end edges on the workpieces. Grinding the dies to have their edges curved in two dimensions—to match a transverse profile and to produce a curving end edge—would entail unacceptably high costs.

On the other hand, cutting flat strip into individual workpiece blanks and then passing the blanks through forming rollers is seldom practicable. A piece of metal to be roller formed must have adequate length, in order to be controlled against edgewise sideward movement as it passes from one to another of the forming roller pairs. Ordinarily, control cannot be maintained unless the piece is long enough to be in simultaneous engagement with at least three pairs of forming rollers.

A typical workpiece that presents all of the above mentioned problems is a component of a reflector-diffuser assembly for a fluorescent lighting fixture. The assembly, which fits into the fixture in front of the fluorescent tubes to diffuse their light, comprises a rectangular frame that supports a grid-like array of reflecting elements or louvers. Each louver is folded along its longitudinal centerline to have a narrow V-shaped transverse profile, but each leg of the V is curved across its width to provide for effective light reflection and diffusion. The array comprises a set of longitudinal louvers that are spaced apart at regular intervals across the width of the assembly and a set of transverse louvers that are spaced apart at similar intervals along its length. The louvers of each set are slotted to receive those of the other set, so that the two sets of louvers interengage like the partition members in an egg crate. The frame that supports the louvers comprises end walls and side walls, each curved across its width, and therefore each louver must have its opposite end edges curved to match the transverse profile of the frame walls between which it extends. In addition, there must be small tabs or lugs on each louver, projecting endwise from its end edges, to be received in slots in the respective frame walls, for holding the parts assembled.

Although the louvers of a fluorescent light fixture diffuser-reflector can be made from thin-gage strip aluminum that lends itself well to roller forming, it has not heretofore been considered feasible to employ roller forming in the production of such louvers. They were therefore produced by a time-consuming and labor-intensive procedure wherein individual blanks were first punched out of sheet or strip stock, and then each blank was subjected to a succession of press forming operations to bring it to the desired profile. For production continuity, a separate press was used for each forming operation, and blanks were transported from press to press in batches. To preserve the shiny, reflective surface of the metal, the blanks in each batch were separated by sheets of paper that prevented them from scratching and scuffing one another. In addition to the hand operations at each press that were required for stacking the blanks and their paper separators, the blanks had to be individually loaded into each press and removed from it. It is evident that those skilled in the art could find no obvious method or means for reducing the high labor costs and the large capital investment in press equipment that were needed with this prior procedure, since the resultant high price of the product was an open invitation to devastating competition from areas where labor is cheap.

SUMMARY OF THE INVENTION

The general object of this invention is to provide apparatus for producing identical workpieces from flat metal strip, each workpiece having a predetermined length between end edges of predetermined shapes and being curved out of flatness across its width to a predetermined profile which is uniform along its length and which includes a small radius fold that parallels its longitudinal edges, said apparatus providing for continuous movement of the material through all stages of its processing from flat strip to finished workpieces and comprising roller forming apparatus and press means having a flying die set.

It is also a general object of this invention to provide simple, inexpensive and very efficient apparatus for producing workpieces of the character described automatically and at a very high rate of production in a continuous-flow process that requires minimal labor.

Another and more specific object of this invention is to provide apparatus whereby workpieces of the character described can be produced in a continuous flow operation, said apparatus comprising roller forming means whereby each workpiece is given a predetermined transverse profile that is uniform along its length and further comprising press means with flying shearing and punching dies, wherein the flying die sets need not have their cutting edges curved to match said transverse profile but the apparatus is nevertheless capable of producing each workpiece with a length that is within a few thousandths of an inch of a predetermined value and with apertures at locations that are maintained within equally close tolerances.

Another object of the invention is to provide apparatus for producing workpieces which are of the character described and each of which has a substantially deep V-shaped transverse profile, with curved side wings of the V, said apparatus providing for steady and continuous advance of the material through successive operations whereby it is converted from flat strip stock to finished workpieces and leaving the finished workpieces with shiny, unscuffed surfaces notwithstanding their passage through forming roller pairs.

Another specific object of this invention is to provide a folding press that is cooperable with roller forming apparatus, whereby each of a succession of elongated workpieces cut off of a continuous roller formed strip is folded along its length to bring it to a narrow V-shaped cross-section, said folding press being so arranged that material moves lengthwise forward continuously and without deceleration from the roller forming means into the folding press and resumes lengthwise forward movement to be carried out of the folding press and away from it as soon as the folding operation is completed.

From what has just been said it will be apparent that it is also an object of this invention to provide a press which is automatically loaded and unloaded and to and from which workpieces are carried by motion in a single direction so that the flow of workpieces through the press is, in effect, continuous with other operations performed upon them in a continuous-flow process.

In general, these and other objects of the invention that will appear as the description proceeds are achieved in apparatus of this invention whereby flat metal strip of indefinite length is converted into identical workpieces, each having opposite front and rear end edges of predetermined shape between which there is a predetermined length and each curved out of flatness across its width to a predetermined profile that is uniform along its length. The apparatus comprises a plurality of roller forming heads that cooperate to define a straight path and whereby strip is advanced lengthwise along said path in a forward direction and at a substantially constant speed and is progressively formed to said profile. The apparatus is characterized by a punch press along said path, spaced to the rear of the roller forming heads, having flying punch and die elements for performing an operation on the flat strip each time it is advanced through substantially a predetermined distance that is no longer than said length, which elements cooperate to punch through the strip at each such operation. Said cooperating punch and die elements are formed and arranged to produce, at each said operation, a front aperture and a rear aperture, said apertures being spaced apart lengthwise along the strip and respectively substantially defining said front and rear end edges. Each said aperture extends across a substantially major portion of the width of the strip but terminates inwardly from the side edges of the strip to leave straplike portions of the strip, one near each of its side edges, which maintain edgewise lateral rigidity of the punched stip that enables the roller forming heads to confine it to said path.

The apparatus is further characterized by a shear press along said path, spaced in said forward direction from the roller forming heads, having two pairs of flying shearing members which operate substantially simultaneously, one pair at each side edge portion of the strip, each pair of flying shearing members being formed and arranged to cooperate in removing the strap-like portions of the strip and thereby separating each workpiece from the remainder of the strip behind it.

Where the profile of the workpiece includes a substantially deep fold that extends lengthwise along it intermediate its side edges, the apparatus further comprises a conveyor extending along said path in the forward direction from the shear press and onto which severed workpiece blanks are delivered from the shear press. The conveyor has a pair of stretches which are spaced apart laterally and which cooperate to support a workpiece blank that is in bridging relation to them. The conveyor is driven to move its stretches forwardly at a second speed, substantially faster than the speed at which the strip is advanced by the roller forming heads, to lengthwise separate from the remainder of the strip workpiece blanks that have been cut off of it at the shear press.

At the front end portion of the conveyor is a folding press that comprises a blade-like ram having an upper edge extending in said forward direction and which is movable up and down between said stretches, and means for driving the ram up from and down to a lowered position at which its upper edge is below a workpiece blank on said stretches. The folding press further comprises a folding die above the ram that has a downwardly opening groove wherein the upper edge portion of the ram is receivable and which cooperates with the same in folding a blank that is between the ram and the folding die. The folding die is movable up and down between defined raised and lowered positions. In its lowered position the folding die is above said stretches and a blank on them, and the ram, in rising and lifting a blank off of said stretches, can clamp the blank against the folding die. In its raised position, which the folding die attains while the ram continues to rise, the ram cooperates with the folding die to fold a workpiece.

BRIEF DESCRIPTION OF DRAWINGS

In the accompanying drawings, which illustrate what is now regarded as a preferred embodiment of the invention:

FIG. 4 is a more or less diagrammatic perspective view of the punch and die elements of the punch press;

DETAILED DESCRIPTION OF PREFERRED EMBODIMENT OF THE INVENTION

Figure 3:
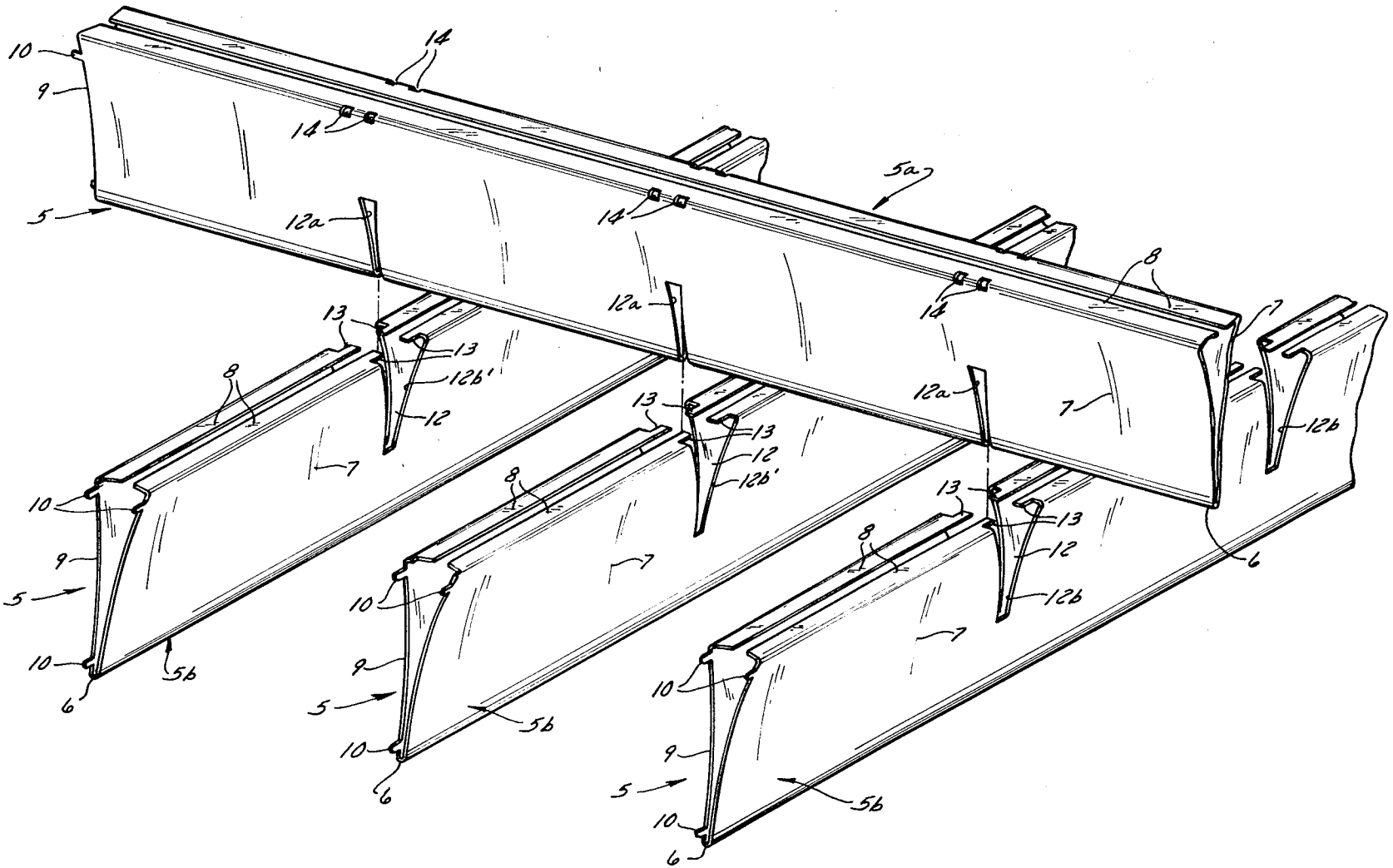
FIG. 3 is a perspective view of a few of the louvers of a reflector-diffuser assembly, typical of workpieces produced by the apparatus of this invention, shown in disassembled relationship.

A typical workpiece 5 that is produced by the apparatus of this invention is one of the louvers of a reflector-diffusor assembly such as is described above. FIG. 3 shows one of a set of lengthwise extending louvers 5*a* of such an assembly, in disassembled relationship to three of a set of transverse louvers 5*b* with which it is to be combined. All of the louvers 5 are made of a light-gage metal such as aluminum and are formed to identical cross-section profiles, each being of narrow V-shape, with a central small-radius bend or fold 6 extending along its length between the wings 7 of the V. Each wing 7 is curved across its width to be outwardly concave. Lengthwise extending marginal edge portions of each louver are bent inwardly towards one another to provide coplanar flanges 8. Each end edge 9 of every louver 5 is curved to fit against a fixture side or end wall (not shown) that is curved across its width like the wings 7 of the louvers and has slots for receiving small tabs 10 that project from the end edge 9 of the louver, whereby the louver is connected to that wall. For reflectivity, the outer surface of every louver must be shiny, unscuffed and unscratched.

Figure 4A:
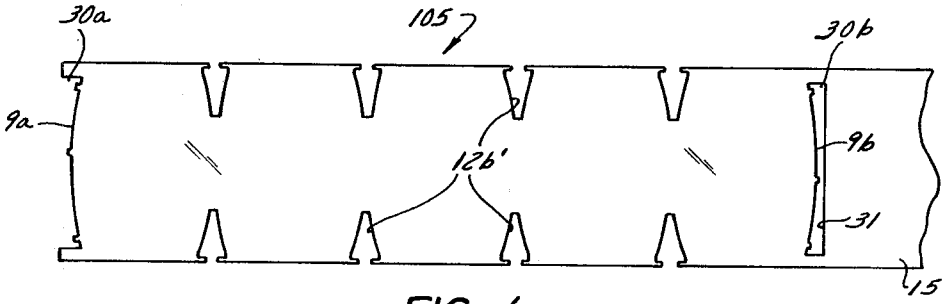
FIGS. 4*a*, 4*b* and 4*c* are plan views of strip at successive stages in its movement through the punch press.
Figure 4B:
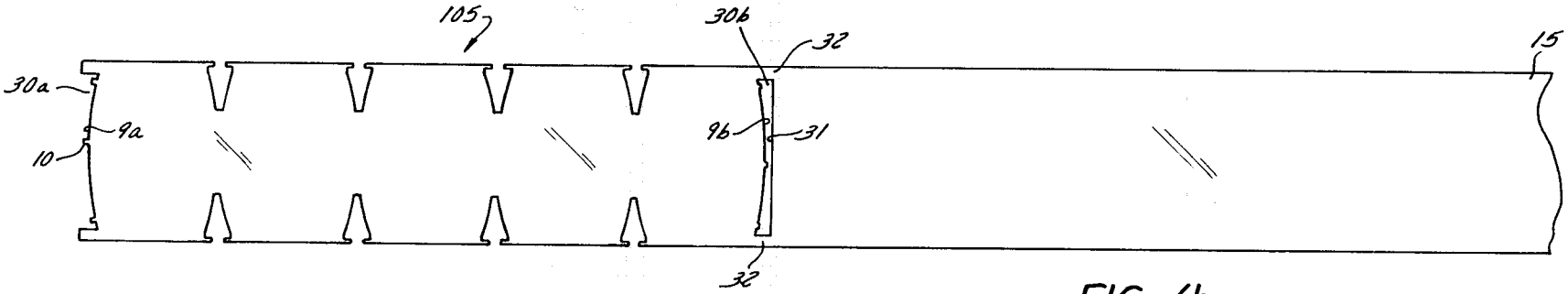
Figure 4C:
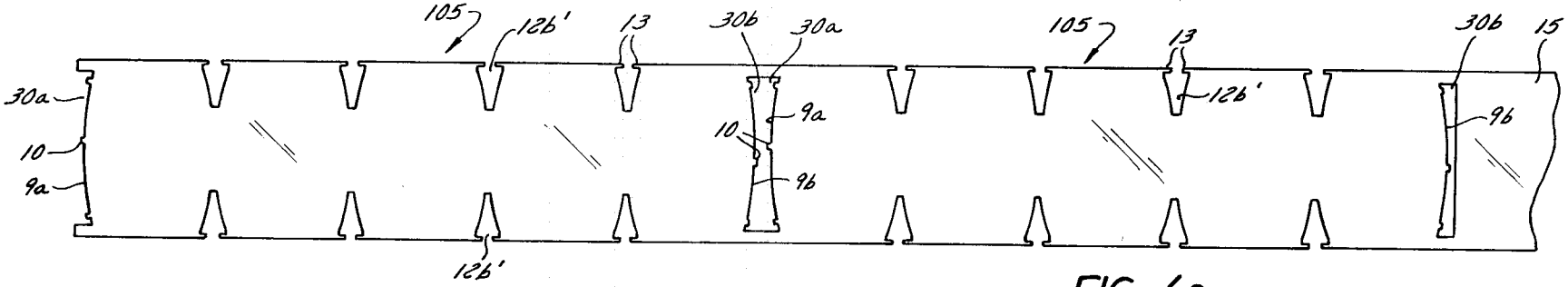
Figures 4D, 4E:
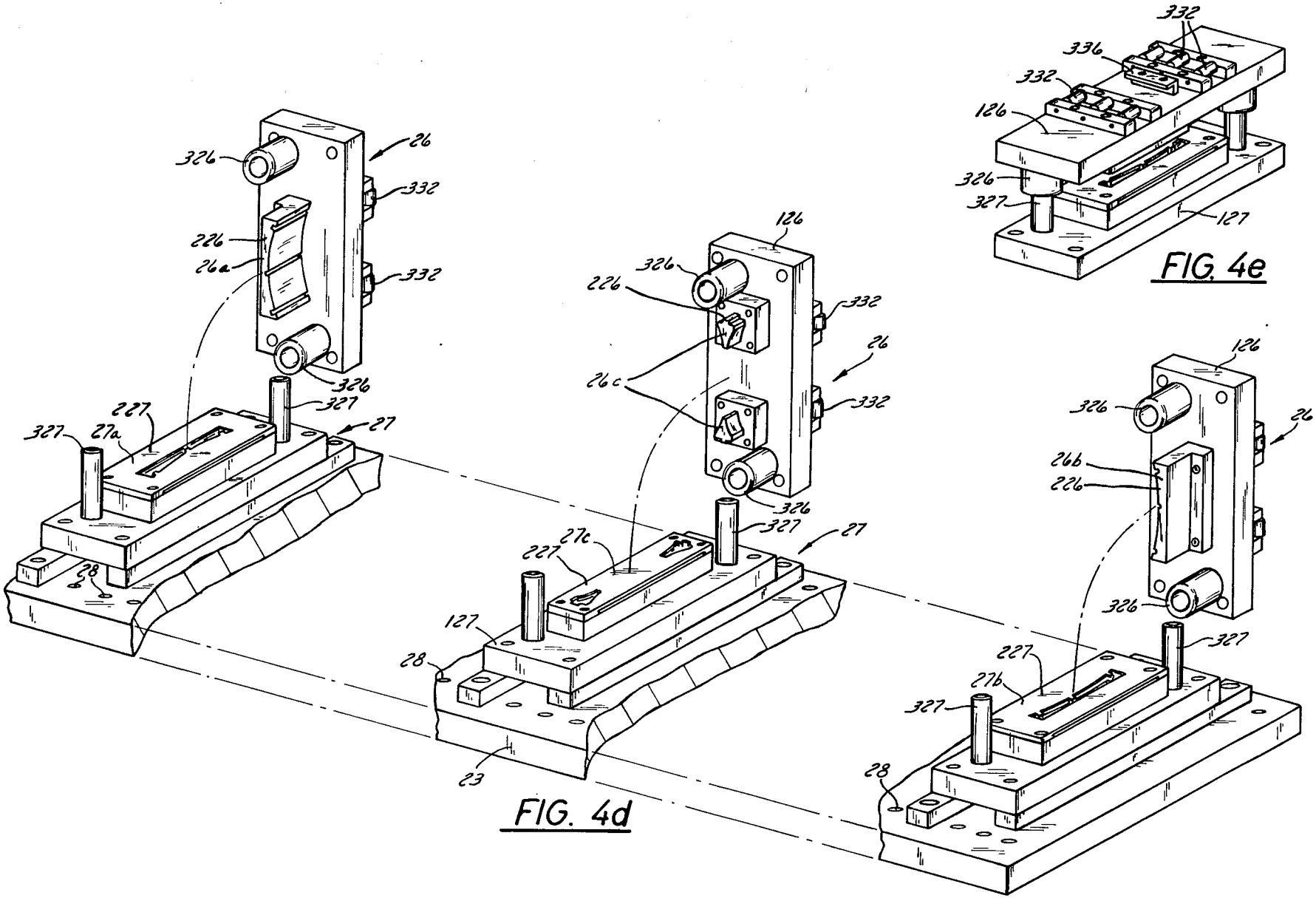
FIG. 4*d* is a more or less diagramattic disassembled perspective view of the flying die sets of the punch press.
FIG. 4*e* is an assembled perspective view of one of the die sets shown in FIG. 4*d;*

The longitudinal and transverse louvers 5*a* and 5*b* of course differ from one another in length, but otherwise differ mainly with respect to slots 12 that allow each louver of one set to interengage with the louvers of the other set, like the partition members in an egg crate. Specifically, assuming that the louvers are disposed in the finished assembly with their folds 6 lower-most, each longitudinal louver 5*a* has a downwardly opening slot 12*a* for every transverse louver, and each transverse louver 5*b* has an upwardly opening slot 12*b* for every longitudinal louver, whereby all of the louvers can be brought together in an assembly in which their flanges 8 are coplanar. It will be apparent that in the flat blanks from which the louvers are formed, each upwardly opening slot 12*b* in a transverse louver 5*b* appears as a pair of transversely aligned notches 12*b'* (FIGS. 4*a*–4*c*) that open to opposite longitudinal edges of the blank, whereas each upwardly opening slot 12*a* in a longitudinal louver 5*a* would appear as a narrow laterally elongated hole across the central portion of the blank. Each of the notches that forms a slot 12*b* in a transverse louver 5*b* interrupts a flange 8 on that louver, but short, lengthwise extending tabs 13 on that flange project partway across the notch, to be received in small holes 14 in the intersecting louver 5*a* for securing the louvers to one another.

Figure 2:
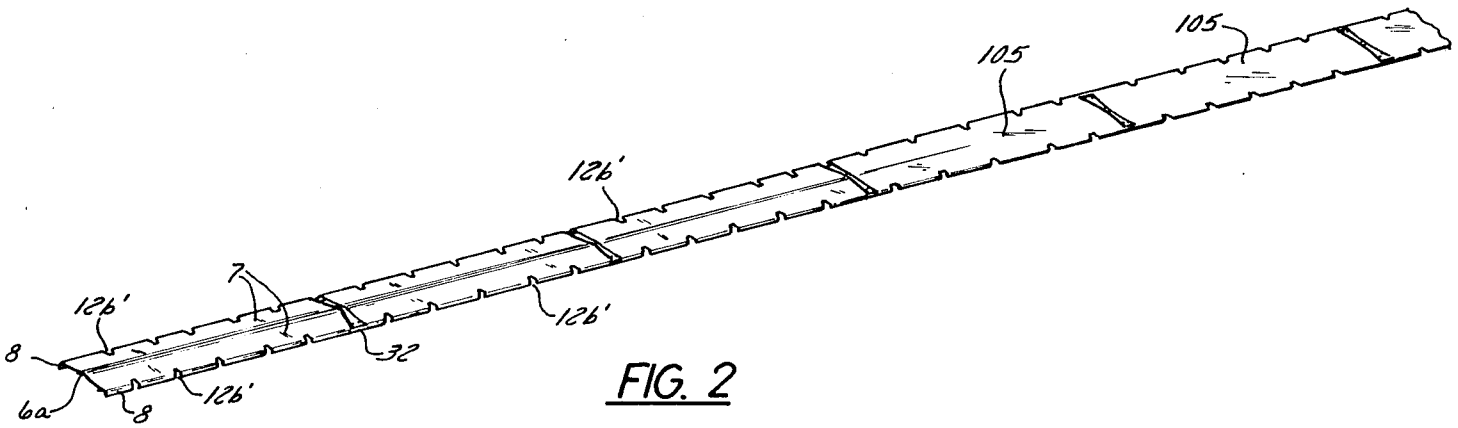
FIG. 2 is a perspective view of a length of strip as it would appear while moving through the roller forming apparatus, showing the transverse profile that is progressively imparted to it by the foller forming heads.
Figure 1:
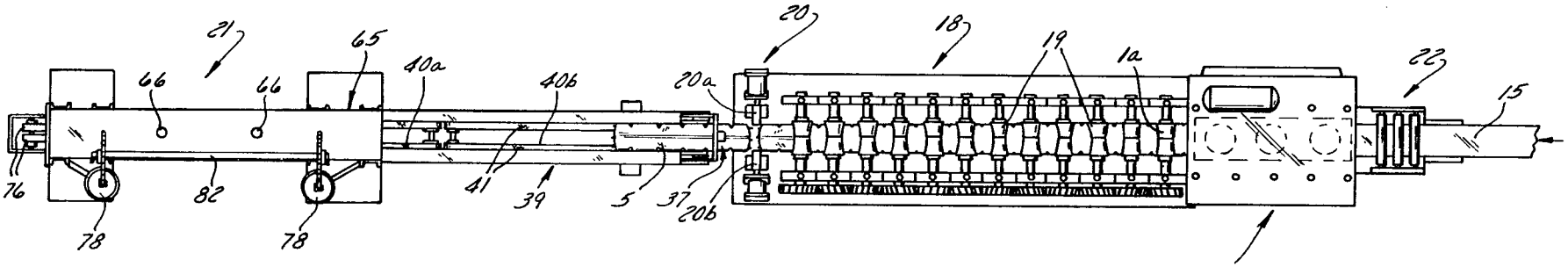
FIG. 1 is a plan view of the apparatus of this invention.

In general, the apparatus of this invention (FIG. 1), which converts an indefinitely long flat metal strip 15 into workpieces like those just described, comprises a punch press 16 by which the flat strip is punched to define lengthwise connected flat workpiece blanks, a roller former 18 comprising a succession of roller forming heads 19 through which the punched strip is passed, a cutoff press 20 for cutting individual workpiece blanks off of the strip 15 after it has been roller formed, and a folding press 21 whereby the fold 6 is formed in each workpiece.

Figure 5:
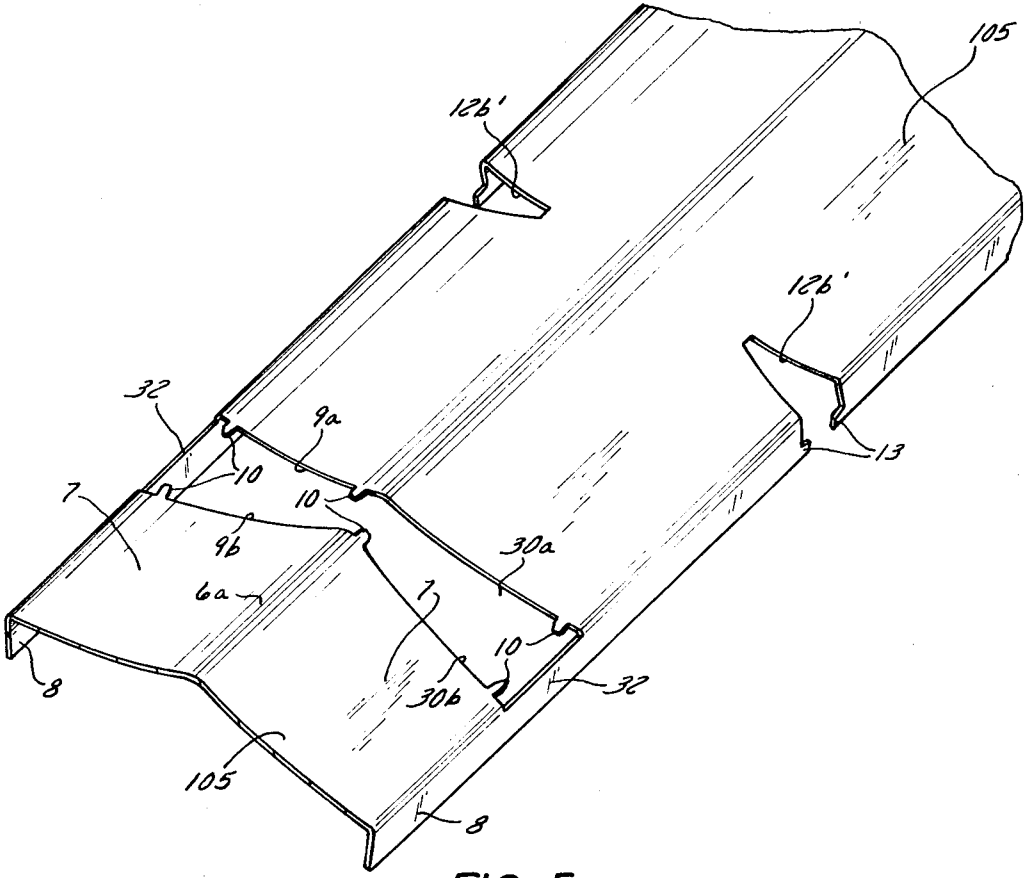
FIG. 5 is a perspective view of a section of strip comprising portions of two adjacent formed workpiece blanks, in the condition in which the material emerges from the roller forming apparatus and moves towards the cutoff press.
Figure 7:
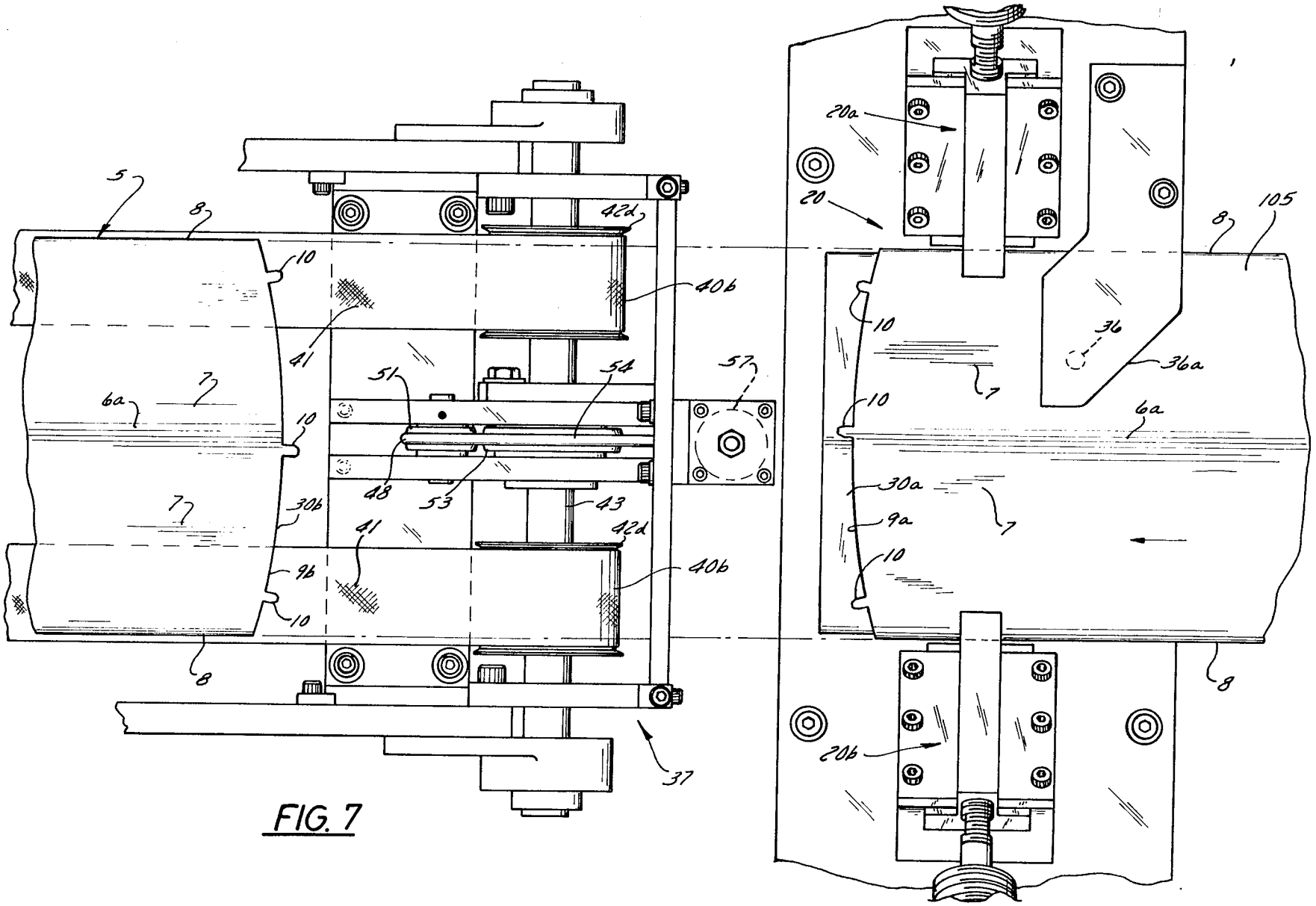
FIG. 7 is a plan view of the cutoff press, the transfer conveyor and the infeed conveyor.

The roller former 18 is generally conventional and therefore it is neither shown nor described in detail herein. Suffice it to say that each of the roller forming heads 19 that it comprises consists of a pair of forming rollers between which the strip 15 passes, and the several heads are aligned with one another along a straight horizontal path that the strip follows through the entire apparatus. The rollers of the forming heads 19 are so driven as to draw the strip 15 lengthwise forward along that path (i.e. to the left in FIG. 1) at a steady speed. As the strip passes through successive forming heads, they progressively bring it to a gull wing profile in cross-section, as can be seen at the left end of FIG. 5 and as shown at 115 in FIG. 8, wherein the wings 7 have the desired widthwise curvature but are connected at a very shallow central crease or V 6*a* that is to be deepened in the folding press 21; and the strip emerges from the roller forming apparatus with the flange 8 at the tip of each wing bent downward.

It will be understood that the flat metal strip 15 from which the workpieces are formed is drawn off of a coil (not shown) that is, as conventional, rotatably supported at some distance behind the roller forming heads 1*a*, along the path that they define. It will also be understood that the apparatus includes conventional straighteners 22 for removing curvature along the length of the strip that results from coiling it and/or from the roller forming operations.

The punch press 16, through which the flat strip 15 passes on its way to the roller former 18, is of a known type that punches through the strip while the strip continues in the steady lengthwise forward motion imparted to it by the roller former.

As more fully explained hereinafter, the punch press 16 apertures the strip to define individual but lengthwise connected flat workpiece blanks. In general, the press 16 has a flying die set comprising male dies or punches 26 and cooperating female dies 27 that are constrained to move horizontally in unison in directions lengthwise of the strip. When a punching operation is to be performed, the die set is rapidly accelerated in the direction of strip travel to bring it to the speed of the strip; and when that speed is attained the male dies are forced down to punch through the strip and are then quickly raised to free them from the strip. As soon as the male dies rise clear of the strip, the forward motion of the die set is stopped, and the die sets are moved rearward along the strip path to return them to a home position from which the next operating cycle begins. Each operating cycle of the flying die set is initiated when a sensor (not shown) that is near the press and along the path of the strip detects passage of a predetermined edge of an aperture that was produced by the press in its immediately preceding operating cycle.

Figure 4F:
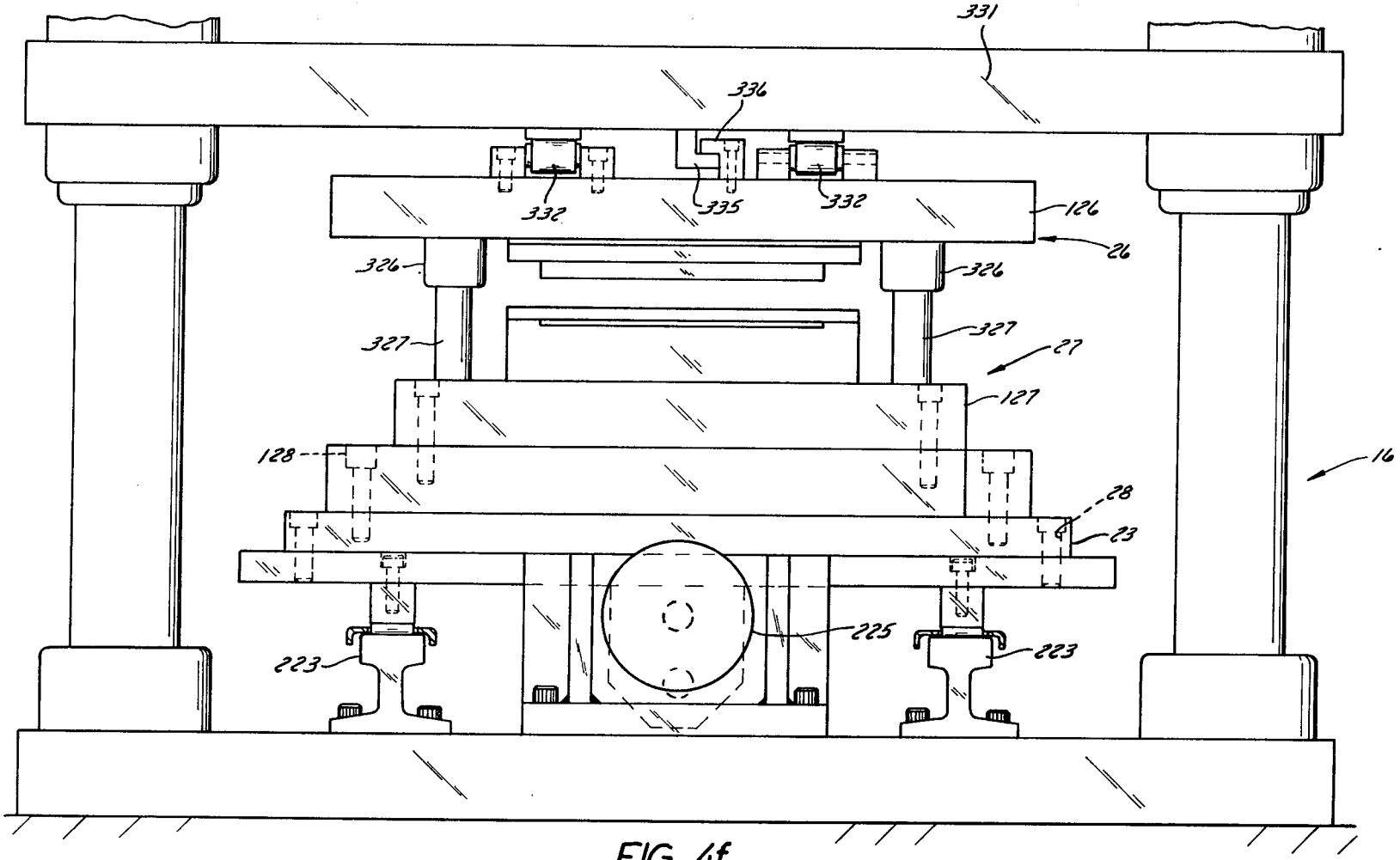
FIG. 4*f* is a view of the punch press in end elevation looking in the direction of strip travel.
Figure 6:
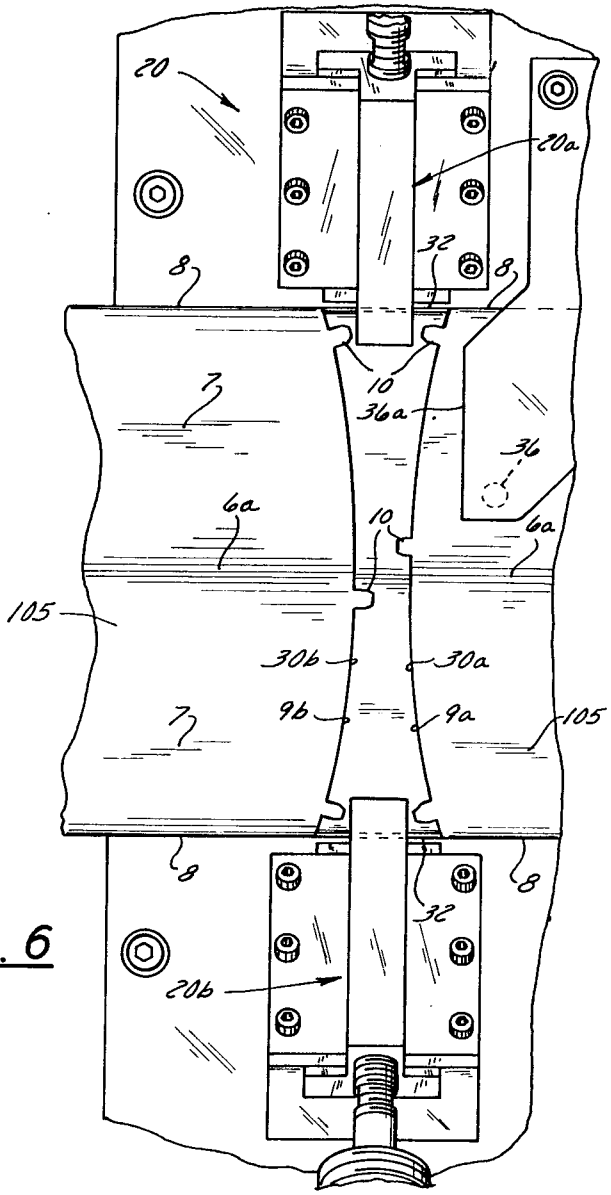
FIG. 6 is a plan view of the cutoff press.

As shown in FIG. 4*f*, the punch press 16 comprises a plate-like carrier 23 which moves back and forth on rails 223 that extend in the direction of strip travel. The carrier 23 is actuated for such flying motion by an air motor 225 that is connected between it and the machine frame. Numerous threaded holes 28 in the carrier 23, opening to its upper surface and arranged in a modular pattern, receive bolts 128 by which cooperating die set elements are detachably secured to the carrier to be readily shiftable and interchangeable for production of workpieces of different modular lengths. Each die set element comprises a die element 27 and its cooperating punch element 26. Each die element comprises a supporting block 127 on top of which the die proper 227 is secured; and each punch element comprises a supporting block 126 that has the punch proper 226 secured to its bottom surface. Upright columns 327 that project up from each die element supporting block 127 cooperate with downwardly projecting bushings 326 fixed to its cooperating punch supporting block to confine the punch element 26 to up and down motion relative to its die element 27 and to flying motion with its die element.

Above the punch and die sets is a ram platen 331 that is confined to up and down motion relative to the stationary press frame. In a known manner, the ram platen 331 is biased upward to a normal raised position in which it is shown in FIG. 4*f*, and when a punching operation is to be performed it is driven downwardly (as by the inflation of air bladders, not shown, that are mounted above it) in a short, fast stroke. Since the die sets are moving forward with the strip during descent of the ram platen 331, its downward force is imposed upon each punch element supporting block through rollers 332 that are mounted on the top surface of that supporting block. A rail 335 that is secured to the underside of the ram platen, extending in the direction of strip travel and having an L-shaped cross-section, is engaged under a gib 336 that is secured to the top of the punch element supporting block, to lift the punch element as the ram platen rises immediately after a punching stroke.

More specific description of the punch press is not needed because such presses are generally known. One that has been found satisfactory for purposes of the present invention, intended for cooperation with roller forming apparatus and having a flying die set, is sold under the trademark "Airam" and is made by Airam Incorporated of Chatsworth, Calif.

It is known and expected that with any press having a flying die set, the length of strip that passes the press will vary slightly from operation to operation. However, with the apparatus of this invention every workpiece has exactly a predetermined length because the punch press 16 so apertures the strip 15 as to define a complete workpiece blank 105 at each punching operation, and variations in repeat interval appear as variations in the distance between lengthwise adjacent workpiece blanks.

The punch and die elements 26, 27 include front punch and die elements 26*a*, 27*a* and rear punch and die elements 26*b*, 27*b*. The front punch and die elements 26*a*, 27*a* cooperate to punch a relatively large hole 30*a* in the strip 15 that defines a front end edge 9*a* of a workpiece blank, and the rear elements 26*b*, 27*b* similarly cooperate to produce a relatively large hole 30*b* that defines a rear end edge 9*b* of the same workpiece blank. These two holes 30*a* and 30*b* are of course spaced apart along the strip by a distance equal to the required workpiece length.

In the same operation wherein the end apertures 30*a*, 30*b* are produced, other cooperating punch elements 26*c* and die elements 27*c* punch out the other holes and notches that are to appear in the workpiece itself such as the holes 14 (FIG. 3) and the notches 12*b*' (FIG. 4*a*–4*c*), so that all of these are accurately located in the blank in relation to the end edges 9*a*, 9*b*.

The end punch and die elements 26*a*, 26*b* and 27*a*, 27*b* are so formed that each of the end holes 9*a*, 9*b* that they respectively produce extends across a major portion of the width of the strip 15 but terminates inwardly from each of its side edges to leave strap-like portions 32 of the strip, one along each side edge, that extend from the end edges 9*a*, 9*b* of the workpiece blank. The strap-like portions 32 that extend from the front end edge 9*a* of each workpiece blank are lengthwise continuous with corresponding strap-like portions extending from the rear end edge 9*b* of its forwardly adjacent blank. In the case of the louver-like workpieces here shown, the strap-like connecting portions 32 have the same widths as the flanges 8 that are to be turned down along the side edges of the strip during the roller forming operation, and they will in fact constitute extensions or continuations of those flanges. Because the connecting portions 32 are at its side edges, the strip retains its edgewise lateral stiffness so that it can proceed through the roller forming heads under complete control and without any tendency towards edgewise lateral shifting.

As initially punched, each of the large holes 30*a*, 30*b* in the strip has a straight laterally extending edge 31 that is opposite its end-defining edge 9*a*, 9*b*. After a punching operation the strip advances through slightly less than the distance between the straight edges 31 of the two large holes 30*a*, 30*b* produced by that operation, so that in the next operation the front punch element 26*a* engages the strip at an area slightly overlapping the area just previously engaged by the rear punch element 26*b*. In effect, therefore, the hole that defines the rear end edge 9*b* of one blank is merged into the hole that defines the front end edge 9*a* of the next adjacent blank. The amount of this overlap is sufficient to accommodate the largest expectable variations in repeat interval through the punch press 16.

The end punch elements 26*a* and 26*b* project down from the punch carrier 23 to a slightly lower level than the other punch elements 26*c* that produce the various holes and notches within the workpiece blank itself. The end punch elements 26*a*, 26*b* therefore enter the metal first, followed by the other punch elements 26*c*. This reduces the force required to drive the punch elements through the metal and also allows the relatively massive and sturdy end punch elements 26*a*, 26*b* to lock the die set to the moving strip 15 before the smaller and more fragile punch elements 26*c* contact the strip.

As the punched and formed strip 15 emerges from the last of the succession of roller forming heads 19, it continues to be propelled lengthwise forward by the roller forming apparatus and is thus carried to the cutoff press 20, which is located at some distance in the direction of strip travel from the roller forming apparatus and along the path defined by that apparatus. The cutoff press 20 comprises two small flying shears 20*a*, 20*b*, each of which shears away one of the strap-like connectors 32 that extend between adjacent connected and formed blanks along the strip. The two shears 20*a*, 20*b* move bodily in unison in their flying traverses as well as acting in unison in their shearing strokes. Operation of the cutoff press 20 is initiated each time a sensor 36 detects passage of a predetermined one of the end edges 9*a*, 9*b* of adjacent connected and formed blanks that have reached the proper position for a cutoff operation. The sensor 36 is mounted on a bracket 36*a* that projects across the strip.

As mentioned above, and as can be seen in FIG. 5, the strap-like connectors 32 in this case comprise continuations of the down-turned flanges 8, and they are therefore straight and flat so that each can be readily sheared away with a simple die set. In the finished louver the flanges 8 must not project beyond either of the curved end edges 9, but they can be permitted to terminate slightly short of those end edges. Therefore, the die sets of the flying shears 20*a*, 20*b* are dimensioned to remove a length of metal that will accommodate the maximum probable distance between adjacent connected blanks, and if the actual distance between blanks is shorter than the length of the removed metal, the result will merely be an insignificant shortening of the flanges 8 on one or both of the affected workpieces.

Figure 8:
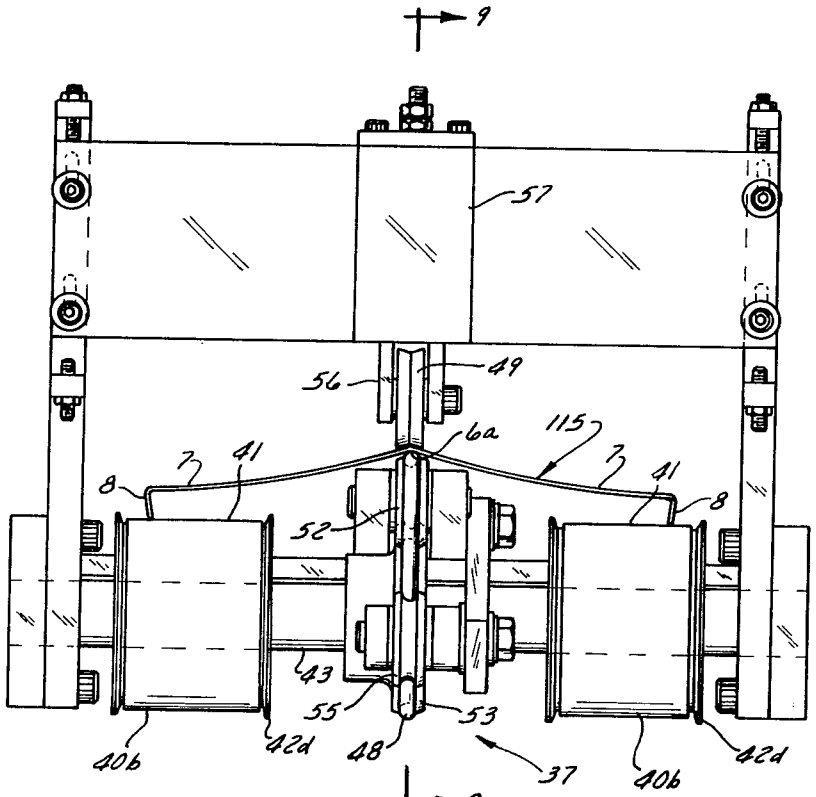
FIG. 8 is a view in rear elevation of the transfer conveyor.
Figure 9:
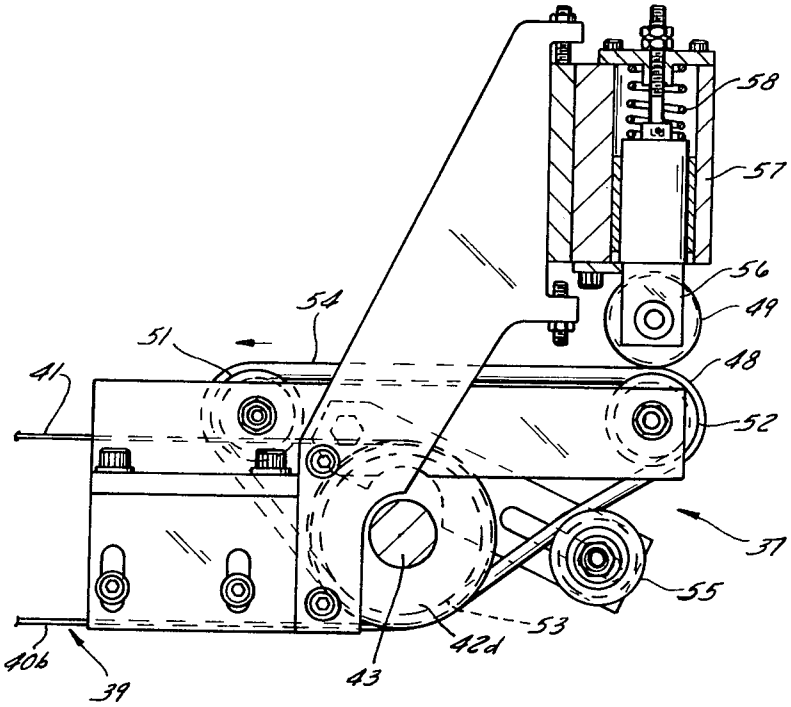
FIG. 9 is a view in vertical section taken substantially on the plane of the line 9—9 in FIG. 8.

As a formed blank at the front of the strip moves forward through the zone of the cutoff press 20, and before it is cut off, it comes into engagement with a transfer conveyor or accelerator 37, best seen in FIGS. 8 and 9, which tends to draw it lengthwise forward at a substantially faster speed than the strip is being advanced by the roller forming apparatus 18. As soon as the front blank is cut off by the press 20, the transfer conveyor 37 accelerates it forwardly, separating it lengthwise from the rest of the strip and bringing it up to the speed of an infeed conveyor 39 that receives it and carries it into the folding press 21.

Figures 10, 11, 12:
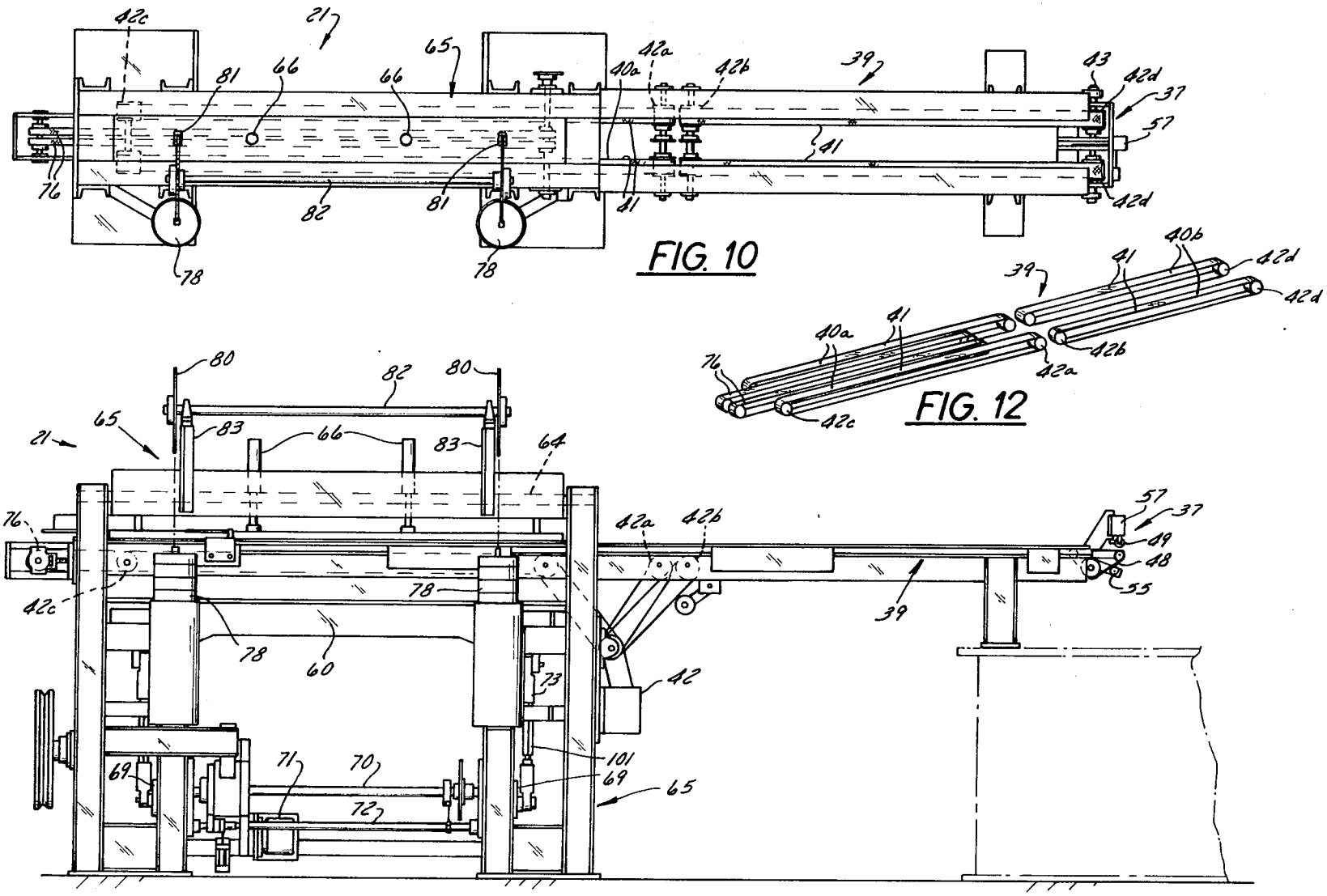
FIG. 10 is a plan view of the folding press and its infeed conveyor.
FIG. 11 is a side view of the apparatus shown in FIG. 10.
FIG. 12 is a diagrammatic perspective view of the infeed and outfeed conveyors.

The infeed conveyor 39 comprises endless flat belts that are arranged to provide a pair of horizontal top stretches 41 which extend parallel to the strip path, along opposite sides of it, and which are spaced apart by a distance such that they can be respectively engaged by the downturned flanges 8 of a workpiece blank that bridges across them. To provide for a substantial lengthwise separation between a blank at the folding press 21 and the one next following it, so that there will be ample time for each folding operation, the infeed conveyor 39 is relatively long. To avoid the inconveniences associated with very long endless belts, each of the top stretches 40 of the infeed conveyor preferably comprises front and rear endless belts 40*a*, 40*b* that have their top stretches lengthwise aligned as shown diagrammatically in FIG. 12. The pulleys that support the belts of the infeed conveyor 39 include coaxial drive pulleys 42*a* at the rear ends of the front belts 40*a* and coaxial drive pulleys 42*b* at the front ends of the rear belts 40*b*, all driven by the same transmission 42 and driving the top stretches 41 forward in unison at about twice the speed at which the strip 15 is advanced by the roller forming apparatus 18. The front ends of the front belts are supported by idler pulleys 42*c*. Coaxial pulleys 42*d* that support the rear end of the rear belt 40*b* and are driven by it serve to drive the transfer conveyor 37.

The transfer conveyor 37 that draws each severed workpiece blank onto the infeed conveyor 39 is disposed on the longitudinal centerline of the strip path to engage the central creased portion of the blank. It comprises an endless accelerator belt 48 of circular cross-section and a hold-down wheel 49. The accelerator belt 48 is trained around two idler pulleys 51, 52 and a drive pulley 53. The idler pulleys 51, 52 define a horizontal top stretch 54 for the accelerator belt. The drive pulley 53, which is below and between the idlers, is fixed on a shaft 43 that carries the rearmost pulleys 42*d* of the infeed conveyor 39, and it thus drives the top stretch 54 for forward motion at the same speed as the infeed conveyor 39. The accelerator belt 48 is also engaged, at its lower rear stretch, by a tensioning idler 55 that maintains it in good driving engagement with the drive pulley 53. The idler pulleys 51, 52 dispose the top stretch 54 above the level of the infeed conveyor stretches 41, for engagement under the shallow crease 6*a* of a workpiece blank, to so support the blank that its downturned flanges 8 can contact the infeed conveyor stretches. The idler pulleys 51, 52 are further so located that the top stretch 54 of the accelerator belt is in overlapping relation to the rear end portions of the conveyor stretches 41.

The hold-down wheel 49, which is freely rotatable, has a V-groove in its periphery that mates with the upper surface of the creased central portion of the formed strip. It is mounted above the rear accelerator belt idler 52, on the bottom of a plunger 56 that is supported in a fixed bracket 57 for limited up and down motion and is biased downward by a spring 58. The hold-down wheel 49 thus forms a nip with the portion of the accelerator belt 48 that is engaged with the rear idler 52.

As a workpiece blank at the front end of the formed strip moves forwardly through the cutoff press 20, and just before it is sheared off by that press, it enters the nip just mentioned. However, the accelerator belt 48 cannot accelerate the blank while it remains attached to the strip, but instead merely slides along under it, the speed of the strip being controlled by the forming rollers, which have a very tight grip on it. Upon being severed from the rest of the strip, the blank quickly accelerates to the speed of the accelerator belt top stretch 54, which moves at the same speed as the infeed conveyor 39.

The folding press 21, to which each severed blank is carried by the infeed conveyor 39, comprises, in general, a ram 60, which has an elongaged blade-like tool portion 60*a* with a straight, horizontal top edge and which moves edgewise up and down between the stretches 41 of the infeed conveyor 39, and a folding die 61 that is mounted above the ram and has an elongated downwardly opening groove 62 in which the upper edge portion of the tool 60*a* is receivable. Unlike the usual press arrangement wherein a ram moves relative to a stationary die, the folding die 61 in the folding press of this invention moves upwardly along with the ram, clampwise cooperating with the ram in lifting the blank off of the infeed conveyor 39 and thus stopping the forward movement of the blank while folding is performed. The die 61, like the ram 60, is guided for vertical motion between defined raised and lowered positions, as described hereinafter.

The ram 60 is driven for its up and down motion by means of a pair of eccentrics 69, one near each end of it, that are fixed to opposite ends of a shaft 70 whereby they are constrained to unison rotation. The shaft 70 is driven from a single-revolution clutch 71 that is normally uncoupled from a constantly rotating drive shaft 72, but it is coupled to that shaft in response to an output from a sensor (not shown), which output is issued when a workpiece blank has arrived at the proper position to be acted upon by the ram. The clutch 71 remains coupled for one revolution of eccentrics 69, during which they first lift and then lower the ram. Each eccentric 69 is connected with the ram by means of an upwardly extending pitman 73.

As a formed and severed workpiece blank is carried into the folding press on the infeed conveyor 39, the folding die 61 is in its lowered position (FIG. 15), wherein its bottom surface is just above the top surface of the blank. The ram 60 is also in its lowered position, with the top edge of its tool 60*a* spaced a little below the crease 6*a* in the blank.

Figure 15:
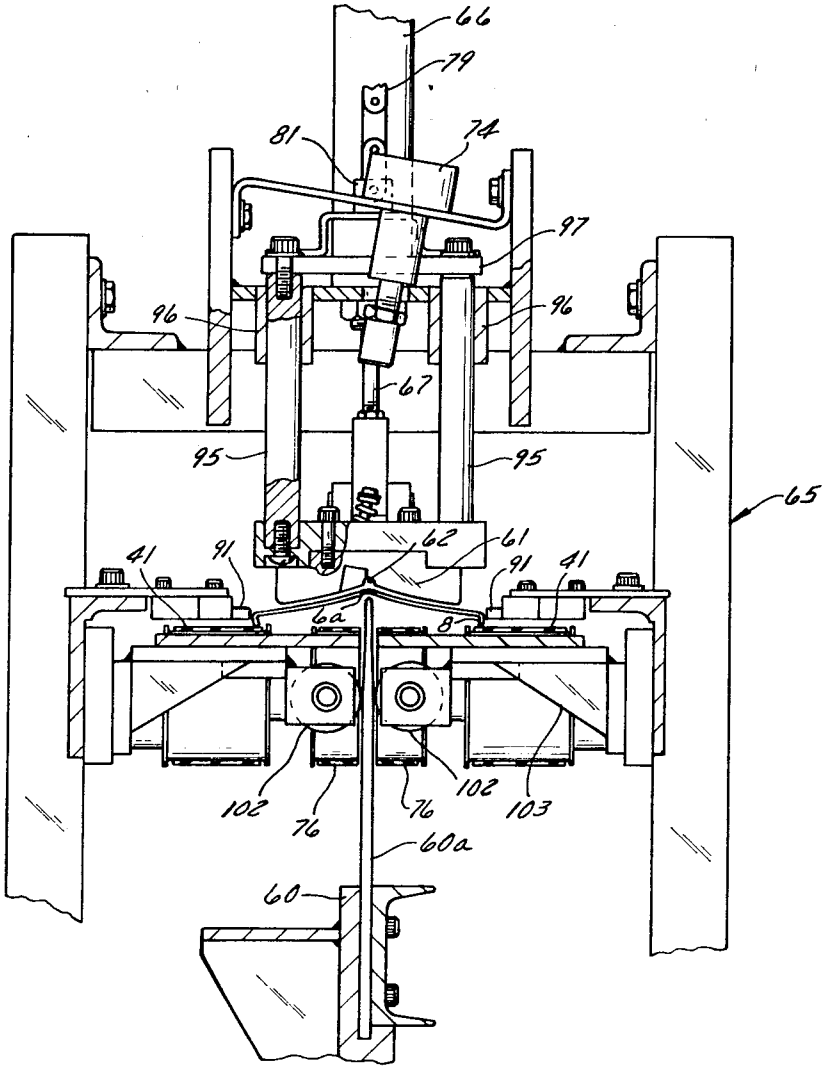
FIG. 15 is a view through the folding press in transverse vertical section, showing conditions that exist just as a workpiece blank arrives in the press and before the ram begins to rise.

As the blank moves into the folding press, its downturned flange portions 8 are engaged (as shown in FIG. 15) by stationary centering guides 91, mounted on the press frame 65 and projecting partway across the respective stretches 41 of the infeed conveyor, whereby the blank is centered to have its downwardly opening crease 6*a* exactly over the top edge of the blade-like ram tool 60*a*.

When the blank has passed fully into the folding press, so that the whole of it is under the die 61 and over the ram 60, an output is issued by a sensor (not shown) that detects passage of an edge of the blank. In response to this output the ram begins to rise, engaging its blade-like tool portion 60*a* in the crease 6*a* in the blank and lifting the blank clear of the infeed conveyor and into clamping engagement with the die 61. As can be seen from FIG. 15, the bottom surface of the die 61 is contoured in general correspondence with the transverse profile of the formed blank, and particularly its wing portion 7; and as explained hereinafter, the die is partially counterbalanced so that the ram, as it lifts the die, does not force the blank into the folding groove 62.

Figure 16:
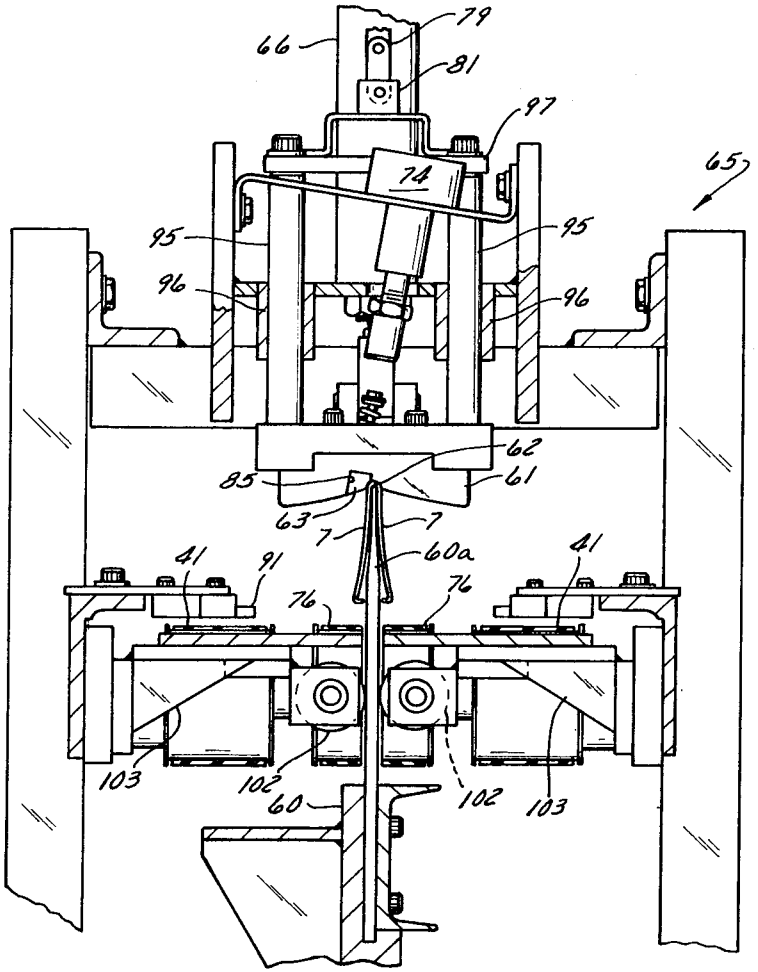
FIG. 16 is a view generally like FIG. 15 but showing the ram at the top of its stroke, just as the workpiece has been folded.

Maintaining the blank clamped against the die 61, the ram 60 lifts the die through a substantial distance until the die engages a pair of vertically adjustable abutments 75 (FIG.13) on the frame 65, one near each end of the die, whereby rising motion of the die is terminated. The ram, however, continues to rise through a further small distance, forcing the blank into the groove 62 in the die and thereby folding the workpiece as shown in FIG. 16. In its raised position the die is high enough above the infeed conveyor 39 to allow the wings 7 of the blank to swing down during folding without interference from that conveyor.

Mounted above the folding die 61, on cross-members 64 of the frame 65 of the folding press, are a pair of pneumatic cylinders 66 that have their downwardly projecting piston rods 67 connected with the die, one near each end of it. As the die is moved up, these cylinders 66 are unpressurized, and they neither oppose nor assist lifting of the die by the ram. However, when the die reaches its upper limit, pressure air is charged into both cylinders 66 so that they hold the die in its raised position as the ram begins its descent.

As the ram 60 moves downward away from the die 61, the workpiece, due to springback, tends to stick in the groove 62 in the die. However, after the ram has moved down through a short distance, a knockout 63 in the die (FIG. 17) is actuated downward relative to the die body by means of a number of small air cylinders 74 that are mounted on the machine frame 65 above the die. The knockout 63, as described hereinafter, defines the bottom surface and one side surface of the folding groove 62 in the die 61; hence descent of the knockout relative to the die body dislodges the workpiece, which drops onto the descending ram. Because of the narrow, inverted V-shaped cross-section to which the workpiece has been folded, it closely but loosely embraces the tool portion of the ram, as is apparent from FIGS. 16 and 17, and maintains a stable position on the ram as the ram descends. Meanwhile the air cylinders 66 continue to hold the die in its raised position.

As the descending ram approaches its lowered position, it deposits the folded workpiece onto an outfeed conveyor 76 that extends through the folding press and forwardly beyond it to carry away the finished workpieces. The outfeed conveyor 76 (FIGS. 12 and 15–17) comprises horizontal top stretches of a pair of endless flat belts, spaced small distances to opposite sides of the ram and disposed between the stretches 41 of the infeed conveyor, to be engaged by the flanges 8 on the folded workpiece. The outfeed conveyor 76 preferably moves somewhat faster than the infeed conveyor 39, to ensure that the folded workpiece will be out of the folding press by the time a new one has been carried fully into it. Outfeed guides 93 are fixed to the press frame to engage opposite sides of a workpiece leaving the folding press and steady it on the outfeed conveyor 76.

As soon as the folded workpiece is clear of the press, the air cylinders 66 are vented to permit the die 61 to descend by gravity to its lowered position. At some time before the die again moves up, the small air cylinders 74 that actuate the knockout 63 are returned to their raised positions.

The above mentioned partial counterbalancing of the weight of the die 61 is effected by means of a pair of counterweights 78 that move up and down at one side of the press frame 65, each connected with the die by a chain 79 that rides over a sprocket 80 on the top of the frame. The chains are connected to the die by means of clevises 81, one near each end of the die. To constrain the die to maintain a lengthwise horizontal attitude as it moves up and down, the sprockets 80 for the chains are secured to a common freely rotatable shaft 82 that is carried by upwardly projecting supports 83 on the top of the frame.

The knockout 63 that dislodges the folded workpiece from the die 61 is in the form of a strip-like insert that extends along the full length of the die and is received in a recess 85 in the bottom of the die body. One side surface 86 of the knockout is vertical, and when the knockout is in its retracted position, fully received in the recess 85, that vertical surface coincides with the plane of symmetry of the folding groove 62 in the die. An opposite side surface 87 of the knockout is inclined downwardly and away from the vertical surface 86 at a small angle to the vertical. When the knockout is fully retracted, its opposite side surfaces 86, 87 are closely received between opposing surfaces of the recess 85. When the knockout descends for release of a workpiece, it does so obliquely, with its inclined side surface 87 maintaining flatwise engagement with the opposing oblique surface of the die. Since the folding groove 62 in the die is conjointly defined by the die body and the knockout, the obliquely downward movement of the knockout has the effect of widening the folding groove to release the workpiece.

To guide the knockout 63 in its oblique downward movement, a number of plunger-like studs 88 project upward from it, at regular intervals along its length, each having its axis parallel to the oblique side surface 87 of the knockout, and each extending lengthwise slideably through a correspondingly inclined bore through the die body that opens upwardly from the recess 85. Surrounding each stud 88 is a coiled compression spring 89 that reacts between an upwardly facing spring seat on the die body and an enlarged head 90 on the stud to bias the knockout to its raised position. The small air cylinders 74 that drive the knockout to its lowered or extended position are mounted on the machine frame 65 above the die, each being so located and oriented as to be coaxial with one of the studs 88 when the die is in its fully raised position. When the ram 60 has moved through a short distance in its descending stroke, the several air cylinders 74 are "fired" simultaneously, driving the knockout downward for release of the workpiece and subsequently retracting to permit the springs 89 to bring the knockout back to its raised position in the die body.

It will be understood that timing of air flow to the pneumatic cylinders 66 and 74 that are associated with the die can be effected in any suitable manner, to be synchronized with the movement of the ram 60.

Proper performance of the folding operation requires that the ram tool 60*a* be accurately received in the folding groove 62 in the die; and therefore the ram and the die must be exactly confined to vertical motion.

To guide the die 61, it has upwardly projecting guide rods 95 (FIGS. 13–17) that extend up through slide bushings 96 fixed on the machine frame. The guide rods 95 are arranged in pairs, one pair near each end of the die, and the two guide rods of each pair are spaced equal distances to opposite sides of the vertical plane of symmetry of the die. At their top ends the two guide rods of each pair are connected by a rigid cross-bar 97, and the clevises 81 for the counterweight chains 79 are attached to those cross-bars.

Figure 13:
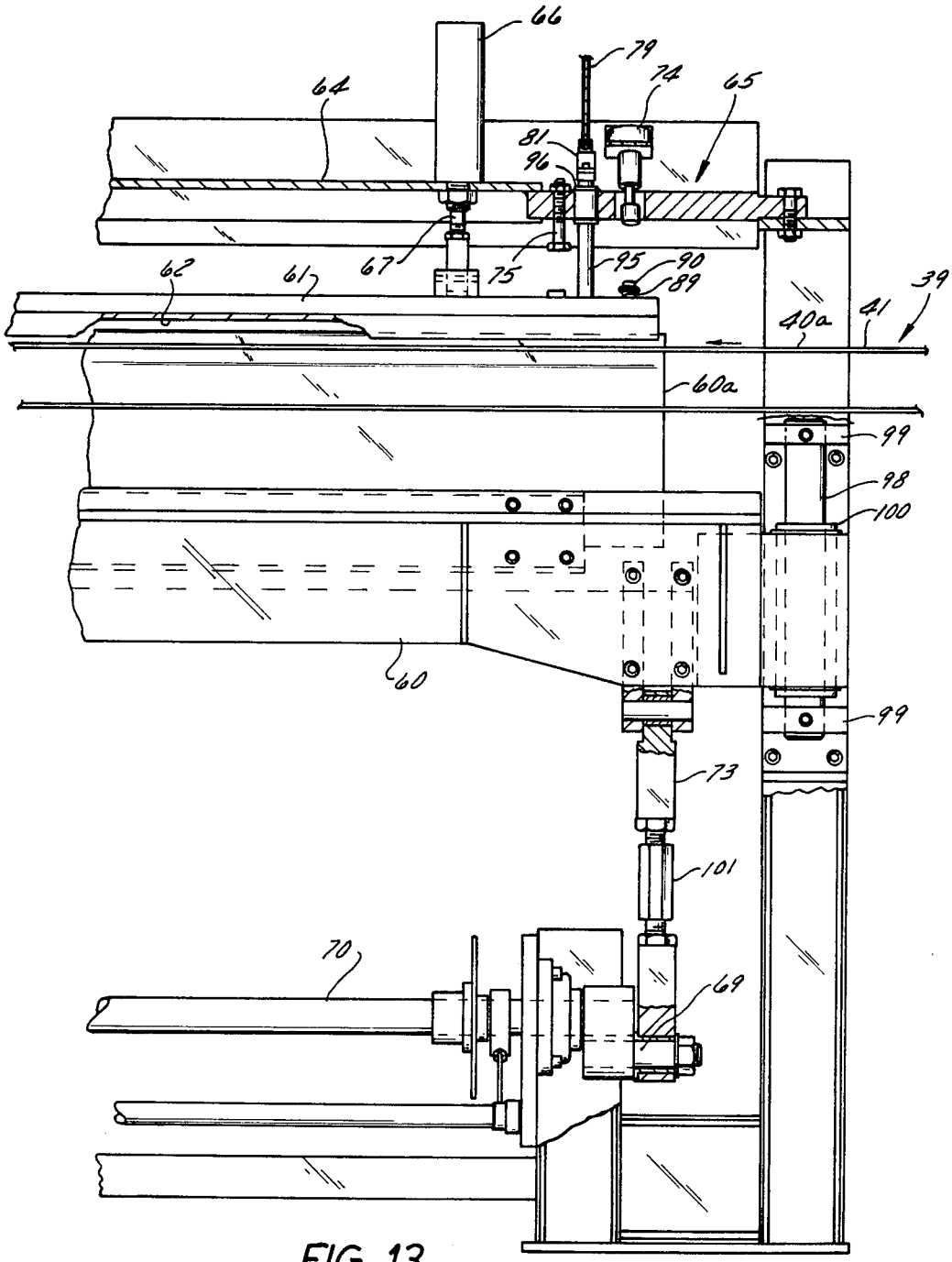
FIG. 13 is a fragmentary view of the folding press, on an enlarged scale, partly in side elevation and partly in longitudinal section.
Figure 14:
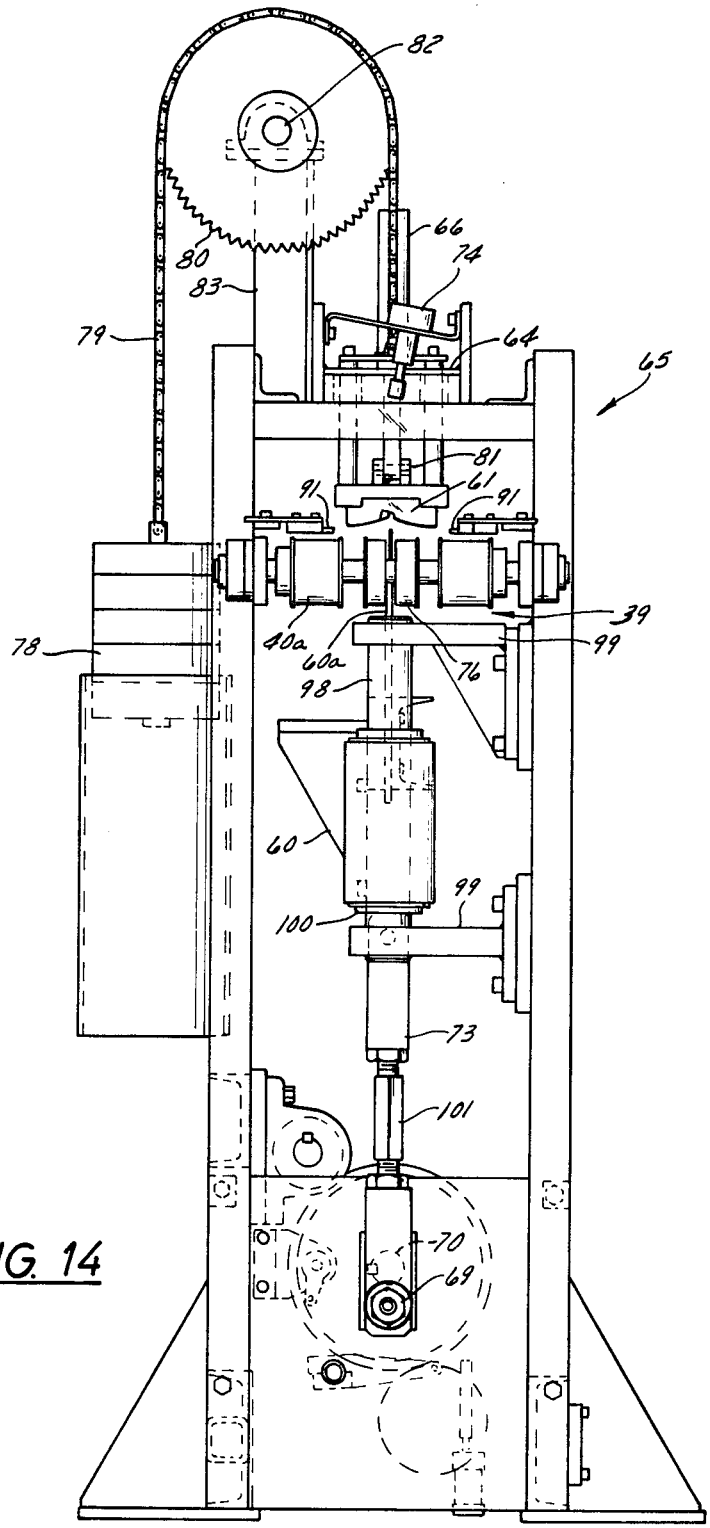
FIG. 14 shows the folding press in rear elevation and in its condition of readiness to receive an incoming workpiece blank to be folded.
Figure 17:
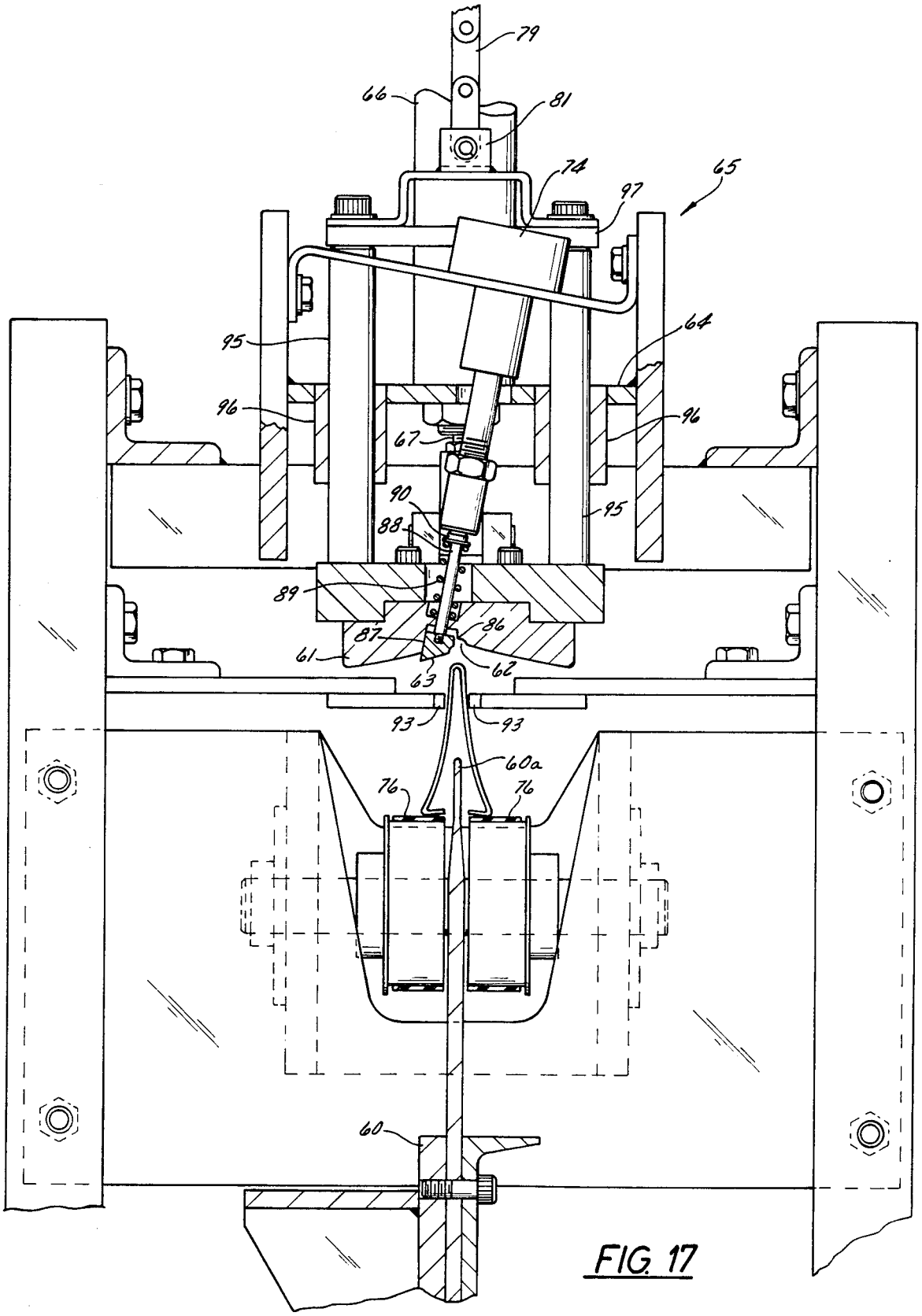
FIG. 17 is a view generally similar to FIGS. 15 and 16 but on a larger scale and showing conditions at the conclusion of a workpiece folding operation.

The ram 60 comprises a sturdy frame to which the blade-like tool portion 60*a* is secured and from which it projects edgewise upwardly, as best seen in FIG. 17. At each end of the press frame 65, beneath the level of the infeed and outfeed conveyors, there is mounted an upright guide rod 98 that has its axis on the vertical plane of symmetry of the die 61 and is supported by rigid cantilivered struts 99 (see FIG. 14). On each end of the ram frame there is a linear bearing or ball bushing 100 which surrounds the adjacent guide rod 98 and slidingly cooperates with it to confine the ram to vertical motion. Each pitman 73 that connects the ram with a driving eccentric 69 is located lengthwise inwardly from, but near, one of the guide rods 98, as best seen in FIG. 13. Each pitman 73 also comprises a turnbuckle 101 whereby the upper edge of the ram tool 60*a* can be adjusted for exact parallism with the bottom of the folding groove 62 in the die. To further ensure exactly vertical movement of the tool portion 60*a* of the ram, its opposite side surfaces are engaged by freely rotatable guide rollers 102 (see FIGS. 15 and 16) that are located between the stretches of the outfeed conveyor belts 76, supported by a cross-member 103 of the frame that extends between the belt stretches, and have their axes parallel to those stretches.

From the foregoing description taken with the accompanying drawings it will be apparent that this invention provides apparatus whereby workpieces of the above described character can be produced from flat metal strips of indefinite length at a very high rate and in a fast, uninterrupted sequence of operations wherein the material remains in substantially continuous lengthwise movement; and it will also be apparent that production of workpieces by means of the apparatus of this invention requires a minimum of labor and ensures uniform finished products that are unscuffed and unscratched.

What is claimed as the invention is:

1. Apparatus for converting a continuous strip of flat metal into identical workpieces, each having opposite end edges of predetermined shapes and each curved out of flatness across its width to a predetermined profile that is uniform along its length, said apparatus comprising a plurality of roller forming heads cooperating to define a straight path and whereby said strip is moved lengthwise in a forward direction along said path and is progressively formed to said profile, said apparatus being characterized by:

a punch press spaced to the rear of the roller forming heads along said path and having flying cooperating punch and die elements which (1) are arranged to remove metal from the strip substantially simultaneously from both of a pair of areas of the strip that are spaced apart lengthwise of the strip and between which there remains a portion of the strip that comprises a workpiece blank, and (2) are so configured that each said area (a) extends across a major portion of the width of the strip to define one of said end edges but (b) terminates inwardly from the side edges of the strip to leave strap-like portions of the strip, adjacent to its side edges, that connect said workpiece blank with a lengthwise adjacent portion of the strip and enable successively produced workpiece blanks to pass through the roller forming heads as a continuous strip.

2. Apparatus for converting flat metal strip of indeterminate length into identical workpieces, each having opposite front and rear end edges of predetermined shape between which the workpiece has a predetermined length, and each curved out of flatness across its width to a predetermined profile that is uniform along its length, said apparatus comprising a plurality of roller forming heads cooperating to define a straight path and whereby strip is advanced lengthwise along said path in a forward direction at a substantially constant speed and is progressively formed to said profile, said apparatus being characterized by:

a punch press along said path, spaced to the rear of the roller forming heads, for performing an operation on the strip each time it is advanced through substantially a predetermined distance that is longer than said length, said press having flying punch and die elements which cooperate to punch through the strip at each said operation, said elements being formed and arranged to produce, at each said operation, a front aperture and a rear aperture, (1) said apertures being spaced apart lengthwise along the strip and respectively substantially defining said front and rear end edges, and (2) each said aperture extending across a substantially major portion of the width of the strip but terminating inwardly from the side edges of the strip to leave strap-like portions of the strip, one near each of its side edges, which maintain edgewise lateral rigidity of the strip that enables the roller forming heads to confine it to said path.

3. The apparatus of claim 2, further characterized by: a cutoff press along said path, spaced in said forward direction from said roller forming heads, having two pairs of flying cooperating shearing members which operate substantially simultaneously, one pair at each side portion of the strip, each pair being formed and arranged to remove one of said strap-like portions of the strip and thereby sever a workpiece from the remainder of the strip behind it.

4. The apparatus of claim 3, for producing workpieces wherein said profile includes a substantially deep fold in the workpiece that extends lengthwise along it, intermediate its side edges, further characterized by:

A. an infeed conveyor (1) having a pair of endless elements, each having a stretch which extends along said path in said forward direction from the cutoff press and onto which severed workpieces are delivered therefrom, said stretches being spaced apart laterally and facing upwardly to cooperate in carrying a workpiece in bridging relation to them, and (2) having means for driving said endless elements to move said stretches constantly forward at a second speed substantially faster than said substantially constant speed, to lengthwise separate a workpiece carried on said stretches from the remainder of the strip from which it has been severed; and B. a folding press at the front end portion of said conveyor comprising (1) a ram movable up and down and having a blade-like tool portion between said stretches with an upper edge extending in said forward direction, (2) means for driving said ram up from and down to a lowered position at which said upper edge is below a workpiece on said stretches, and (3) a folding die above said ram, said folding die (a) having a downwardly opening groove wherein the upper edge portion of the ram is receivable and which cooperates with the same in folding a workpieces that is between the ram and the folding die, and (b) being movable up and down between (i) a defined lower position wherein the folding die is above said stretches and a workpiece on them, to be engaged by a workpiece lifted off of said stretches by the rising ram, and from which the die is raised by the ram, and (ii) a defined raised position which the folding die attains while the ram continues to rise and at which the ram cooperates with the folding die to fold a workpiece.

5. The apparatus of claim 4, further characterized by:

C. an outfeed conveyor having a path of stretches extending in said forward direction (1) located between said stretches of the infeed conveyor, (2) disposed at opposite sides of said tool portion of the ram and extending forwardly therefrom, and (3) moving in said forward direction at a speed no slower than said second speed, onto which the descending ram deposits each folded workpiece for transport out of the folding press.

6. Apparatus for converting lengthwise continuous flat metal strip into substantially identical elongated workpieces, each having a fold along its length intermediate its side edges and having curvature across its width between said fold and at least one of its side edges, said apparatus comprising:

A. roller forming means through which strip passes in constant lengthwise motion in one direction at a first speed and by which said curvature is imparted;

B. a flying shear at a cutoff station spaced in said direction from the roller forming means whereby transverse cuts are made through the strip as it continues in said motion, to sever workpiece blanks from it;

C. an endless conveyor comprising a pair of laterally spaced apart top stretches cooperable to support a workpiece blank bridging across them and (1) which extend from said cutoff station to a folding station spaced in said direction from the cutoff station and (2) which move constantly in said direction at a second speed, faster than said first speed, to lengthwise separate each severed blank from the strip while carrying the blank to the folding station;

D. a folding press at said folding station comprising (1) a ram having a blade-like upper portion movable up and down between said stretches and having an upper edge extending in said direction, (2) means for actuating said ram up from and down to a lowered position at which said top edge is below a blank on said stretches, and (3) a folding die above said ram, said folding die (a) having a downwardly opening groove wherein the upper edge portion of the ram is receivable and which cooperates with the same in folding a workpiece that is between the ram and the folding die, and (b) being movable up and down between (i) a defined lower position wherein the folding die is above said stretches and a workpiece blank on them but is engageable by the blank as it is lifted off of said stretches by the rising ram, and from which the folding die is raised by the ram, and (ii) a defined raised position which the folding die attains while the ram continues to rise and at which the ram cooperates with the folding die to fold a workpiece.

7. The apparatus of claim 6, further characterized by: said folding die comprising (1) a die body having (a) bottom surfaces extending laterally to opposite sides of said groove, and (b) a substantially vertical surface that defines one side of said groove;

(2) a die insert in said die body having a substantially vertical surface that opposes said substantially vertical surface on the die body and defines the opposite side of said groove; and (3) cooperating slidingly engaged guiding surfaces on the die body and the die insert whereby the die insert is confined to movement relative to the die body in opposite vertically oblique directions (a) upwardly and towards said one side of said groove to a normal position in which the die insert is maintained during raising of the ram, and (b) downwardly and away from said one side of said groove to provide for widening the groove to release a folded workpiece therefrom.

8. A press for performing, on each of a succession of workpieces that move steadily into the press in a forward direction along a defined substantially horizontal path, an operation whereby a width dimension of each workpiece that is transverse to said direction is substantially reduced, said press comprising a ram which is substantially narrower than the workpiece as it moves into the press and a die which cooperates with the ram in performing said operation and which is substantially wider than the ram, said press being characterized by:

A. a conveyor having (1) endless elements that define a pair of upwardly facing and parallel stretches that extend in said forward direction and have front portions at opposite sides of the ram, said stretches being cooperable to support workpieces that bridge across them as those workpieces move towards the ram, and (2) means for driving said endless elements to cause said stretches to move steadily in unison in said direction;

B. said ram being movable between (1) a lowered position in which workpieces carried on said stretches can pass over the ram, and (2) a raised position in which the ram supports a workpiece at an elevation above said stretches; and C. said die (1) being above the ram, and (2) being movable between (a) a defined lowered position wherein the die is above said stretches and clear of a workpiece supported on them but is engageable by a workpiece as it is lifted off of said stretches by the rising ram, and (b) a defined raised position to which the die is lifted by the rising ram, which the die attains while the ram continues to rise, and at which the die cooperates with the rising ram to perform said operation.

9. A press comprising a die and a ram that is movable relatively toward and from the die between first and second positions, said ram being spaced from the die in its first position to permit workpieces to be loaded into and unloaded from the press and being cooperable with the die in moving to its second position to perform an operation upon a workpiece confined between it and the die whereby a width dimension of the workpiece is substantially reduced, said press being characterized by:

A. a conveyor having a pair of upwardly facing parallel stretches which extend horizontally in a forward direction and have front end portions at opposite sides of the ram, said stretches being driven for steady unison movement in said forward direction and being laterally spaced apart to cooperate in carrying into the press a workpiece that bridges across them with its said width dimension transverse to said direction;

B. said ram (1) having a width transverse to said direction that is smaller than said width diemension of workpieces supported on said conveyor, (2) having its first position at a level such that workpieces supported on said conveyor can pass over it, and (3) having its second position at a substantially distance above its first position such that in moving from its first position to its second position it lifts a workpiece off of the conveyor and to an elevation above the same; and C. said die (1) having a width substantially greater than that of the ram, and (2) being movable up and down between (a) a defined lower position at which the die is above the conveyor and a workpiece thereon but is engaged by a workpiece lifted by the ram, and (b) a defined raised position to which the die is raised by the ram, which the die attains while the ram continues to move to its second position, and at which the die cooperates with the ram in performing said operation.

10. The press of claim 9 wherein said operation is a folding operation, further characterized by:

(1) said ram being blade-like and having an upper edge extending substantially parallel to said stretches, and (2) said die having a downwardly opening groove in which the upper edge portion of the ram is receiable.

11. The press of claim 10 wherein said die comprises a die body which defines one substantially vertical side surface of said groove and which has a recess that opens downwardly, and further comprises an elongated knockout in said recess that is movable relative to the die body up to and down from a normal position wherein the knockout complements the die body in defining said groove and from which the knockout is moved down to disengage a workpiece from said groove, further characterized by:

(1) said knockout having a substantially vertical surface which opposes said side surface defined by the die body and which defines the opposite side surface of the groove when the knockout is in its normal position; and (2) means guiding said knockout for obliquely vertical motion in the die body whereby the knockout moves up to its normal position in converging relation to said side surface defined by the die body and downwardly from that position in diverging relation to that surface to thus widen the groove and release a folded workpiece therefrom.

12. The press of claim 11, further characterized by:

(1) biasing means reacting between the die body and said knockout to urge the latter to its normal position, (2) a relatively stationary frame upon which the ram and the die are mounted for their up and down movements, and (3) actuator means on said frame, engageable with said knockout when the die is in its raised position to drive the knockout down from its normal position.

13. The press of claim 10, further characterized by:

means for holding the die in its raised position while the ram moves from its second position to its first position.

14. The press of claim 9 further characterized by:

said conveyor further comprising a second pair of laterally spaced parallel stretches, one at each side of the ram and between the first mentioned stretches, which move in unison in said forward direction at a speed at least as high as that of said first mentioned stretches and which extend beyond the ram in said forward direction to carry workpieces out of the press.

* * * * *